US005494463A

United States Patent [19]

Nishio et al.

[11] Patent Number: 5,494,463

[45] Date of Patent: Feb. 27, 1996

[54] ELECTRICAL CONNECTOR HAVING A PLURALITY OF EFFECTIVELY ARRANGED CONTACTS

[75] Inventors: Atsushi Nishio; Masaru Onuki, both of Mito, Japan

[73] Assignee: Mitsumi Electric Co., Ltd., Japan

[21] Appl. No.: 165,252

[22] Filed: Dec. 10, 1993

[30] Foreign Application Priority Data

Dec. 29, 1992 [JP] Japan ..... 4-093608 U

[51] Int. Cl.[6] ..... H01R 13/53

[52] U.S. Cl. ..... 439/181; 439/924.1

[58] Field of Search ..... 439/924.1, 180, 439/181

[56] References Cited

U.S. PATENT DOCUMENTS

| | | | |
|---|---|---|---|
| 4,034,172 | 7/1977 | Glover | 439/924 |
| 4,079,440 | 3/1978 | Ohnuma | 439/924 |
| 4,088,384 | 5/1978 | Gumb | 439/924 |
| 4,124,877 | 11/1978 | Vollenweider | 439/924 |
| 4,146,291 | 3/1979 | Goff | 439/181 |
| 4,483,575 | 11/1984 | Krüger | 439/924 |
| 4,591,221 | 5/1986 | De Brouckere | 439/181 |
| 4,628,392 | 12/1986 | Didier | 439/81 |
| 4,927,382 | 5/1990 | Huber | 439/924 |
| 4,955,817 | 9/1990 | Sugai | 439/924 |
| 5,080,613 | 1/1992 | Orui | 439/924 |

FOREIGN PATENT DOCUMENTS 335672 4/1991 Japan .

*Primary Examiner*—Kurt Rowan

*Attorney, Agent, or Firm*—Andrus, Sceales, Starke & Sawall

[57] ABSTRACT

A plurality of contacts come into contact with plurality of respective contacts of an opposite connector so as to make an electrical connection. The plurality of contacts of the relevant electrical connector have an arrangement so that a first contact, comprising at least one contact among the plurality of contacts of the electrical connector, comes into contact with a corresponding contact among the plurality of contacts of the opposite connector, prior to the remaining contacts of the plurality of contacts coming into contact with the remaining contacts among the plurality of contacts of the opposite connector.

8 Claims, 1 Drawing Sheet

ELECTRICAL CONNECTOR HAVING A PLURALITY OF EFFECTIVELY ARRANGED CONTACTS

BACKGROUND OF THE INVENTION

The present invention relates to an electrical connector comprising a molded base and having a plurality of contact members which may project from and retreat into the molded base as is appropriate. The present invention in particular relates to an electrical connector suitable for electrically connecting electronic devices including ROM devices for example.

An example of a connector in the prior art will now be described with reference to FIG. 1. In the arrangement of FIG. 1, a predetermined number (7, for example) of metallic contact members 54 are arranged in a plastic molded base 52. In this arrangement, these contact members 54 are arranged in parallel and may retreat into and may project from the molded base 52 as is appropriate. These contact members 54 are pressed against a respective number of opposite contact members 64 provided in an opposite connector 60. As a result, the contact members 54 retreat into the molded base 52 accordingly so that the connectors 50 and 60 are connected to one another and cooperatively achieve electrical connection therebetween.

In the electrical connector 50 of the prior art, each of the contact members 54 projects from the molded base 52 with the same projection length H. Accordingly, when the connectors 50 and 60 are connected to one another, each contact member 54 comes into contact with the corresponding contact member 64 simultaneously.

Normally in an electrical connector having an arrangement such as that of the connector 50, the contact members located at both ends among the contact members 52 are used for grounding and the remaining contact members are used for transfer of signals.

These connectors 50 and 60 are provided in respective electronic devices and the respective devices may be charged with an electrostatic charge, for example, undesirably in general before the two connectors are connected to one another. Such an electrostatic charge, for example, may act to damage ROM devices contained in the electrical devices when the connectors are connected to one another where all the contact members 54 and 64 come into contact simultaneously as mentioned above. Such an electrostatic charge, for example, may also cause malfunction in the devices.

SUMMARY OF THE INVENTION

An object of the present invention is to provide an electrical connector having an arrangement by which it may be prevented that an electrostatic charge, for example, may cause malfunction in the devices and/or may damage the devices as a result of the electrostatic charge flowing through the signal-carrying contact members of the connector.

To achieve the object of the present invention, the electrical connector according to the present invention comprises a plurality of contacts for coming into contact with a respective plurality of contacts of an opposite connector so as to make an electrical connection, said plurality of contacts of said electrical connector having an arrangement in which a first contact, comprising at least one contact among said plurality of contacts of said electrical connector, comes into contact with a corresponding contact among said plurality of contacts of said opposite connector, prior to the remaining contacts of said plurality of contacts coming into contact with the remaining contacts among said plurality of contacts of said opposite connector.

In this arrangement, the first contact (contact member) comes into contact with the corresponding contact of the opposite connector prior to the remaining contacts doing so. As a result, an electrostatic charge, for example, with which the relevant devices are charged, may be discharged to ground through the initially connecting first contact when the electrical connector is connected with the opposite connector. After that, the remaining contacts used for carrying the signal come into contact with the corresponding contacts of the opposite connector.

Further, in the electrical connector according to the present invention, said first contact (projecting furthest outwards) preferably comprises contacts located either at both ends or near both ends of said plurality of contacts. Accordingly, both the end or near end contacts come into contact to the corresponding contacts of the opposite connector prior to the middle-position contacts doing so when both the connectors are connected with one another. In such a connection manner, both the connectors do not tend to shake in the connection operation so as to align with one another after these first connectors come into contact with the corresponding contacts of the opposite connector. Thus, it becomes easy to cause the opposite connector to be pressed straight into the relevant electrical connector and vice versa. Consequently, ease in the connection operation is obtained in such an arrangement in comparison to an arrangement in which the first contacts (projecting furthest outwards) comprise middle-position contacts instead.

Further, in the electrical connector according to the present invention, said plurality of contacts preferably have the same original construction and the electrical connector has a construction for bending the plurality of contacts so that the first contact projects most outwardly. That is, all the contacts (contact members) have the same shapes originally and the same dimensions and then the connector has a construction to support the contact members at different positions thereof so as to make the projection lengths thereof different. In such an arrangement, there is no necessity to make differently constructed contact members, and thus the manufacturing cost may be reduced.

Other objects and further features of the present invention will become more apparent from the following detailed description when read in conjunction with the accompanying drawings.

DESCRIPTION OF THE PREFERRED EMBODIMENT

Figure 2:
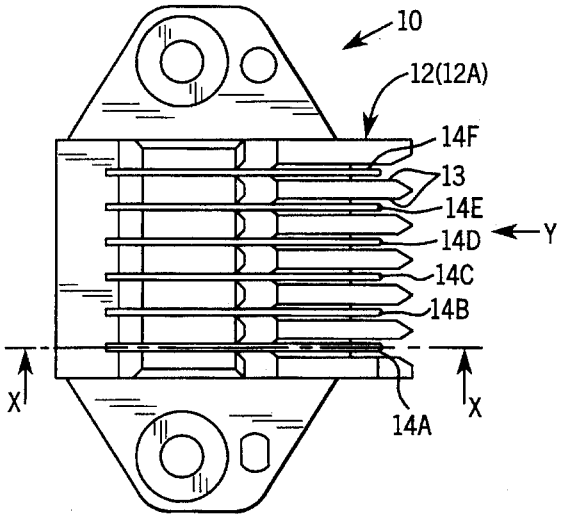
FIG. 2 shows a plan view of an embodiment of an electrical connector according to the present invention.

An embodiment of an electrical connector according to the present invention will now be described with reference to FIGS. 2, 3, and 4.

The electrical connector 10 comprises a molded base 12 comprising an upper molded portion 12A and lower molded portion 12B each made from a plastic material. A number of slits 13 are formed on the molded base 12. A predetermined number (6 pieces in this embodiment) of metallic contact members 14 (14A, 14B, 14C, 14D, 14E and 14F) are placed in the respective slits 13. These contact members 14 are arranged in parallel to one another and may retreat into and project from the respective slits 13 as is appropriate. Similarly to the conventional manner as mentioned above, a corresponding number of contact members 64 of an opposite connector 60 are pressed onto the contact members 14 of the relevant connector 10. As a result of this pressing, the respective contact members 14 retreat into the molded base 12, thus both connectors 10 and 60 being electrically connected to one another. Further, both the connectors 10 and 60 are also constructively connected to one another by means of suitable constructions therefor not shown in the drawings.

The 6 contact members 14 are made of elastic rod materials having the same dimensions and originally have the same shapes formed by bending the rod materials. An end 14*a* of each contact member 14 is borne by a respective one of bearing portions 12A-1 and 12A-2 (to be described below) formed at the top of an end of the upper molded portion 12A. The other end 14*b* of each contact member 14 is fixed in a respective one of fixing portions 12A-3 formed at the bottom the other end of the upper molded portion 12A. As a result of the other end 14*b* being fixed to the fixing portion 12A-3, the elastic property of the contact member 14 causes the end 14*a* of each contact member 14 to be pressed upward in FIG. 3 onto the respective one of the bearing portions 12A-1 and 12A-2. The bottom edge of the other end 14*b* of each contact member 14 is placed in the lower molded portion 12B and is elastically pressed onto a respective one of lead terminals 16 located therein and shaped like the letter U as shown in FIG. 3.

Figure 1:
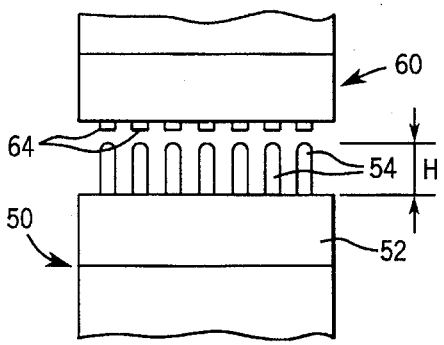
FIG.1 PRIOR ART
FIG. 1 shows an example of an electrical connector in the prior art.
Figure 3:
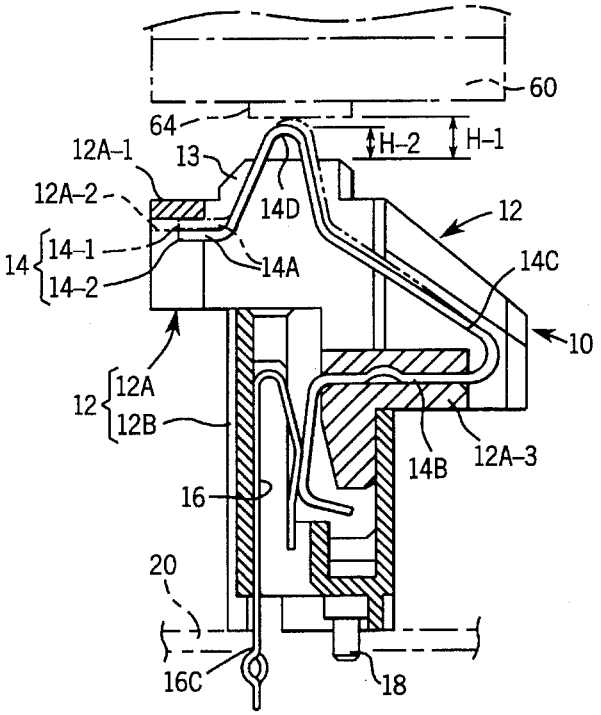
FIG. 3 shows a side elevational sectional view taken along line X—X of FIG. 2.
Figure 4:
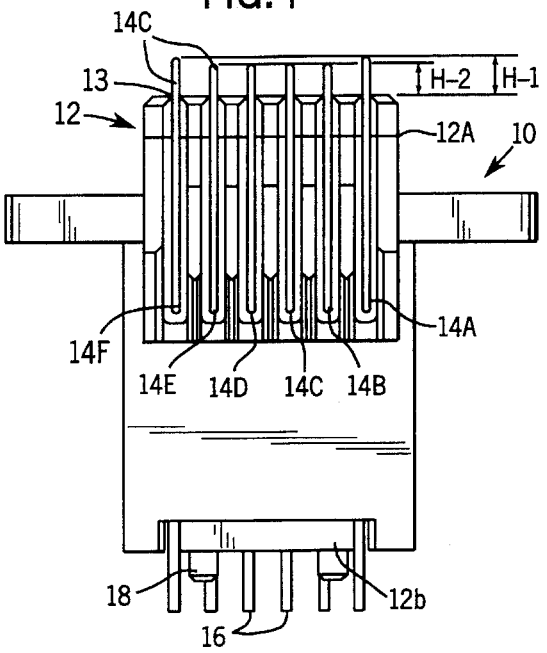
FIG. 4 shows a front view along an arrow Y of the electrical connector of FIG. 2.

A middle portion 14*c* of each contact member 14 is bent so as to be shaped approximately like the numeral 7 or the letter L for example as shown in FIG. 3. Thus, the elastic property of each contact member 14 may be utilized easily. As shown in FIG. 3, a curved contact portion 14*d* is formed at an upper portion of each contact member 14 so that the contact portion 14*d* projects from the top of the respective slit 13 by a respective projecting length H-1 or H-2 described below. The projecting contact portion 14*d* may retreat into and again project from the slit 13 accordingly in response to a force applied thereto. The connector 10 has a positioning pin 18 for positioning the connector 10 on a substrate 20 when the connector 10 is mounted on the substrate 20.

In the connector 10 of the embodiment according to the present invention, a respective bearing position where the end 14*a* of each contact 14 is borne by means of the respective bearing portions 12A-1 and 12A-2 is arranged as follows: The bearing positions for the contact members 14A and 14F located at both ends among the plurality of contact members 14A, 14B, 14C, 14D, 14E and 14F are higher than those for the remaining ones 14B, 14C, 14D and 14E. Such an arrangement can be achieved by making the vertical thicknesses of the bearing portions 12A-1 for the contact members 14A and 14F thinner than those of the bearing portions 12A-2 for the remaining ones 14B, 14C, 14D and 14E. Thus, the surface on which the bearing portions 12A-1 and 12A-2 are formed has steps so as to create the above-mentioned difference thicknesses in the bearing portions 12A-1 and 12A-2.

As a result of the above-mentioned different thicknesses in the bearing portions 12A-1 and 12A-2, the bending angles at the middle portions 14*c* of the contact members 14 are different as shown in FIG. 3. Consequently, the projecting lengths H-1 associated with the contact members 14A and 14F located at the two ends are greater than those H-2 associated with the middle contact members 14B, 14C, 14D and 14E.

By such an arrangement of the contact members 14, connection of the connector 10 with the opposite connector 60 first causes the contact members 14A and 14B, located at the two ends and further projecting as mentioned above and used for grounding, to come into contact with by the corresponding contact members 64 of the opposite connector 60. As a result of this coming into contact, an electrostatic charge, for example, present in one device of the two devices associated with the connectors 10 and 60 may be discharged to ground through the circuit formed by the coming into contact of the contact members 14A and 14F. After that, the remaining contact members 14B, 14C, 14D and 14E, used for carrying signals, come into contact with the corresponding contact members 64 of the opposite connector 60.

Thus, it may be prevented that an electrostatic charge, for example, flows through the signal-carrying contact members 14B, 14C, 14D and 14E so as to cause malfunction in or damage the electronic device associated with one of the connectors 10 and 60.

Further, as the contact members 14A and 14F located at both ends come into contact with corresponding ones of an opposite connector prior to the remaining ones 14B–14E doing so, it may be prevented that the connector 10 shakes when it is connected to the opposite connector. As a result, it is easy to press the opposite connector 60 onto the relevant connector 10 in an aligned condition and vice versa. Thus, better operation performance in connecting to another one may be obtained in comparison to a case where the projecting lengths associated with the middle-positioned contact members 14B–14E are greater than those associated with the end-positioned ones 14A and 14F.

Further, in the arrangement of the connector 10 according to the present invention, first all the contact members 14 have the same dimensions and the same shapes and then the different projecting lengths are created by making the respective bearing positions different as mentioned above. Thus, only a single common type of contact member is required to be manufactured even though the final shapes thereof are different as mentioned above. Consequently, the manufacturing cost can be reduced.

However the method of manufacturing an electrical connector according to the present invention is not limited to that in which only the common type (common dimension and shape) contact members are manufactured. It is also possible to manufacture them in a way in which contact members located at both ends are shaped different from the remaining ones, being formed so that the end-positioned contact members project further than the remaining ones.

Further, the contact members 14 are not limited to those having the elastic property of the embodiment. Contact members (contacts) to be used in electric connectors according to the present invention may comprise materials with other properties. One example of such contact members is a rod-shaped rigid contact pin pressed by means of a coil spring so as to be able to project from and retreat into the molded base. Further, coil springs themselves may also be used as contact members of electrical connectors according to the present invention. In the case of using coil springs, the projecting lengths may be made different by making coil springs with different lengths or by having different bearing positions for the coil springs. Thus, the end-positioned contact members may be made to have projecting lengths greater than those of the remaining ones.

Further, the present invention is not limited to the above described embodiments, and variations and modifications may be made without departing from the scope of the present invention.

What is claimed is:

1. An electrical connector comprising:

a body (12) for said electrical connector;

a plurality of deflectable contacts (14*a–f*) mounted in a row in said body, each contact of said plurality of contacts comprising a first end portion (14*b*), a middle portion (14*c*, 14*d*) and a second end portion (14*a*), said middle portion coming into contact with a respective one of a plurality of contacts of another electrical connector when said electrical connector is moved toward said another electrical connector in a first direction;

a holding portion (12A-3) of said body for holding said first end portion of each contact of said plurality of contacts of said electrical connector so that said first end portion extends laterally along a second direction normal to said first direction;

each contact of said plurality of contacts of said electrical connector being bent between said first end portion and said middle portion so that said middle portion (14*c*, 14*d*) of said each contact extends obliquely along a third direction lying between said second direction and said first direction, said middle portion of said each contact having a contact portion (14*d*) at an end of said middle portion, said end of said middle portion being an end adjacent to said second end portion (14*a*) of said each contact and protruding in said first direction externally from said body beyond a first surface of said body that lies generally parallel to said second direction; said second end portion having a first part lying at an angle to said contact portion and oblique to said first direction;

a pressing portion (12A-1; 12A-2) of said body for pressing a second part of said second end portion (14*a*) of each contact of said plurality of contacts to restrain movement of said contacts in said first direction, said pressing portion being formed so that said contact portion of at least one contact of said plurality of contacts of said electrical connector protrudes in said first direction beyond the contact portions of the remaining contacts of said plurality of contacts of said electrical connector.

2. The electrical connector according to claim 1, wherein said plurality of contacts of said electrical connector have substantially identical constructions.

3. The electrical connector according to claim 1, wherein said at least one contact is a contact located at an end of said row of said plurality of contacts of said electrical connector.

4. The electrical connector according to claim 3, wherein said at least one contact further comprises two contacts one of which is located at each end of said row of said plurality of contacts of said electrical connector.

5. The electrical connector according to claim 1, wherein said plurality of contacts of said electrical connector are formed so as to retreat in a direction opposite to said first direction in response to being pressed by said plurality of contacts of said another connector.

6. The electrical connector according to claim 1, wherein said plurality of contacts of said electrical connector extend substantially in parallel with one another in said row of contacts.

7. The electrical connector according to claim 1, wherein said at least one contact comprises a contact for flowing undesirable electric charge to ground when said at least one contact comes into contact with a respective one of said plurality of contacts of said another connector.

8. The electrical connector according to claim 1, wherein all contacts except at least one contact of said plurality of contacts of said electrical connector comprise a contact for carrying an electrical signal.

* * * * *